United States Patent [19]

Carpenter

[11] 3,975,702

[45] Aug. 17, 1976

[54] CIRCUIT BREAKER

[75] Inventor: Horace G. Carpenter, North Dighton, Mass.

[73] Assignee: Texas Instruments Incorporated, Dallas, Tex.

[22] Filed: Apr. 14, 1975

[21] Appl. No.: 567,899

[52] U.S. Cl. ..... 337/62; 337/78

[51] Int. Cl.[2] ..... H01H 71/16

[58] Field of Search ..... 335/62, 65, 66, 68, 335/71, 78

[56] References Cited

UNITED STATES PATENTS

| | | | |
|---|---|---|---|
| 3,501,729 | 3/1970 | Brackett | 337/62 X |
| 3,564,174 | 2/1971 | Clarke | 337/62 X |

*Primary Examiner*—George Harris
*Attorney, Agent, or Firm*—John A. Haug; James P. McAndrews; Russell E. Baumann

[57] ABSTRACT

A circuit breaker has a contact member with a pair of arms which extend from the member in spaced side-by-side relation. The contact member also has a thermostatic portion which moves in response to an increase in temperature to move the distal ends of the arms away from each other. A latching plate has a pair of spaced latch surfaces engaged with the distal ends of the respective contact member arms for manually moving the contact member into closed circuit position. The latch surfaces permit the distal arm ends to slide from the latch surfaces as the arms move apart when the thermostatic portion is heated to a selected temperature in response to the occurrence of an overload current in the breaker circuit, thereby to allow the contact member to move automatically to an open circuit position under a spring bias. One latch surface has a shallow groove retarding sliding movement of an arm end thereon so that, when the thermostatic portion of the contact member is heated, the distal end of the other arm preferentially slides on the other latch surface, this preferential sliding permitting the circuit breaker to open a circuit at a more precisely predetermined overload current level.

4 Claims, 3 Drawing Figures

CIRCUIT BREAKER

Known circuit breakers have utilized thermostatic contact members having a pair of arms which extend from the member in spaced side-by-side relation and have utilized a latch plate having a pair of latch surfaces engaged with the distal ends of these arms for manually moving the contact member to a closed circuit position, In these known circuit breakers, the distal ends of the arms slide from the latch surfaces when the thermostatic contact member is heated by an overload current, thereby to permit the contact member to move automatically to an open circuit position under a spring bias. These known circuit breakers have been advantageous in maintaining their overload current settings at a constant level even though the breakers have been subjected to extensive manual operation over a long service life. However, such circuit breakers have required the allowance of substantial tolerances with respect to the overload current level at which the circuit breakers would automatically open a circuit.

It is an object of this invention to provide a novel and improved circuit breaker; to provide such a circuit breaker which is automatically operable to open a circuit on the occurrence of a precisely predetermined level of overload current; to provide such a circuit breaker which is manually operable to open a circuit and which is adapted to maintain its overload current setting over a long service life even though subjected to extensive manual operation; and to provide such a circuit breaker which is of simple, reliable and inexpensive construction.

Briefly described, the novel and improved circuit breaker of this invention includes a contact member having a pair of arms extending from the member in spaced side-by-side relation and having a thermostatic portion which moves in response to an increase in temperature to move the distal ends of the arms away from each other. The circuit breaker also includes a latch plate having a pair of latch surfaces which are engaged with the distal ends of the respective contact member arms for permitting manual movement of the latch plate to move the contact member into and out of a closed circuit position. The latch plate is disposed so that the distal ends of the contact member arms slide from the latch surfaces when the thermostatic portion of the contact member is heated by an overload current in the breaker circuit. In this regard, it has been found that either arm may slide on its latch surface before the other arm undergoes corresponding sliding movement. Further, one arm may tend to slide a short distance on one latch surface and may then stop allowing the other arm to begin to slide on its surface as the relative balances of the frictional and other forces change. These random variations in the sliding movement can introduce irregularity in operation and tend to result in automatic opening of the breaker circuit at overload current levels which vary over a significantly wide range. In accordance with this invention, however, one of the latch surfaces is provided with surface means such as a shallow groove in the latch surface which relatively retards sliding movement of an arm end on that surface. Accordingly, when the thermostatic portion of the contact member is heated by an overload current so that the arm ends tend to move apart, arm separation primarily occurs by sliding of a distal arm end on the other latch surface. This preferential sliding of the other arm avoids any irregularity in arm movement and assures that the breaker opens the circuit on the occurrence of a precisely predetermined level of overload current.

Other objects, advantages and details of the circuit breaker of this invention appear in the following detailed description of preferred embodiments of the invention, the detailed description referring to the drawings in which.

Figure 1:
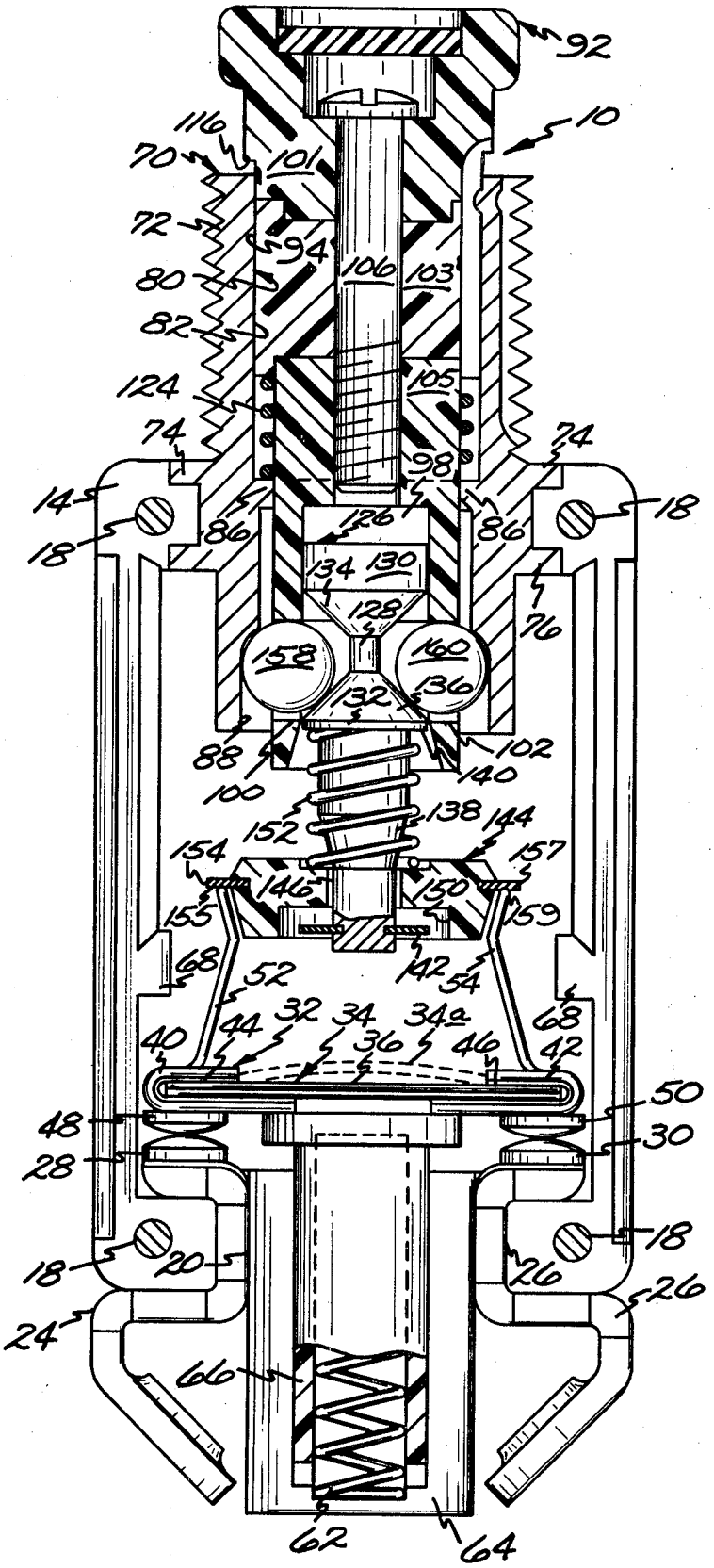
FIG. 1 is a section view along the longitudinal axis of the circuit breaker of this invention illustrating the circuit breaker in a closed circuit position.
Figure 3:
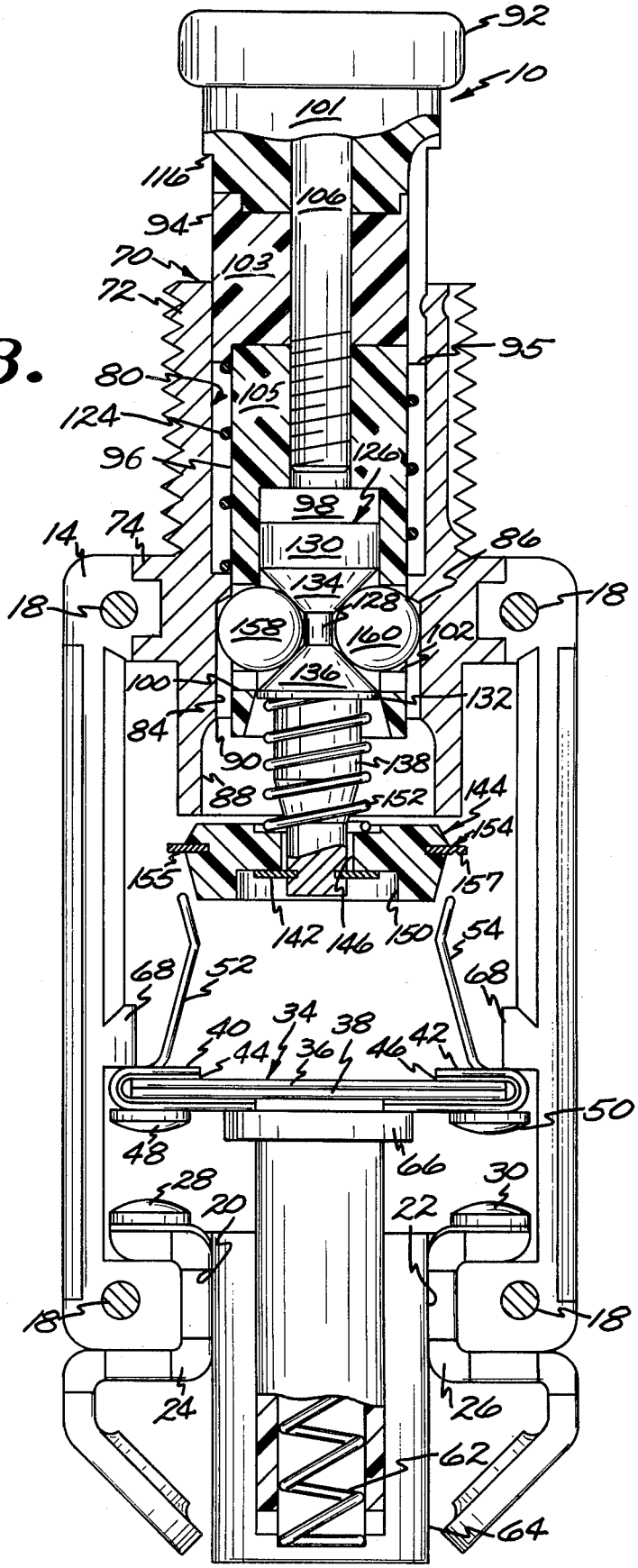
FIG. 3 is a section view similar to FIG. 1 showing the circuit breaker in an open circuit position.

Referring to the drawings, 10 in FIGS. 1 and 3 indicates the novel and improved circuit breaker of this invention which is shown to include a pair of interfitting casing or base halves 14 formed of a rigid, electrically insulating material secured together by rivets 18 or the like, the base formed by the casing halves having recesses 20 and 22 receiving a pair of electrically conductive terminals 24 and 26 having first, spaced electrical contacts 28 and 30 on the respective terminals.

The circuit breaker 10 also comprises a bridging contact member 32 including a composite thermostatic bimetallic portion 34 having a layer of metal 36 of relatively high coefficient of thermal expansion bonded to a layer of metal 38 of relatively lower coefficient of thermal expansion and including a pair of electrically conductive U-shaped metal strips 40 and 42 enclosing respective opposite edges of the bimetallic material 34. A pair of electrical contacts 48 and 50 are secured to respective strips 40 and 42 and the strips are provided with respective upstanding arms 52 and 54, which may be integral with the strips 40 and 42, extending from the contact member 32 in spaced side-by-side relation to each other. U-shaped insulating elements 44 and 46 are preferably bonded in place between the metal strips 40 and 42 and major portions of the edges of the bimetallic material 34. The bimetallic element 34, only an edge of which is shown in FIG. 1, is substantially sheet-like but has a plurality of slots extending into the sheet from the left and right (as viewed in FIG. 1), these slots giving the bimetallic element the form of a continuous strip of material made up of a plurality of interconnected elements each of which extends transversely between the U-shaped strips 40 and 42. One end of this continuous strip is welded to the U-shaped strip 40 and the opposite end of the continuous strip is welded to the U-shaped strip 42. In this arrangement the transverse elements of the bimetallic material 34 are insulated from the U-shaped strips 40 and 42 except where the ends of the continuous strip of the bimetallic material are welded to the U-shaped metal strips. Accordingly, when the contact member 32 is engaged with the fixed contacts 28 and 30 as shown in FIG. 1 for closing a circuit between the fixed contacts, the bimetallic portion 34 of the contact member is adapted to be heated by current flowing through the contact member and, when heated to a selected temperature by the occurrence of a predetermined overload current in that circuit, is adapted to flex upwardly (as indicated by the broken lines **34*a* in FIG. 1) to cause the distal ends of the arms 52 and 54** to move away from each other.

As shown in FIG. 1, the contact member 32 is resiliently biased from the closed circuit position shown in FIG. 1 toward the open circuit position shown in FIG. 3 by means of the compression spring 62, this spring preferably being disposed in a socket or well 64 and being partly enclosed within the socket plunger 66 slidably mounted in the well 64 so that the plunger bears against the contact member 32 urging the contact member to open circuit position. As shown in FIG. 3, the spring 62 biases the contact member toward engagement with stops 68 formed on the casing halves 14.

In a preferred embodiment of the circuit breaker of this invention, the breaker 10 is provided with a latching mechanism indicated generally at 70. As shown, this latching mechanism includes a bushing 72 having flanges 74 and 76 thereon captured between the casing halves 14 and having a central bore 80 with portions 82 and 84 separated by a shoulder 86 and with a relatively larger diameter portion 88 separated from the rest of the base by a shoulder 90. A manually movable operating member 92 is disposed for sliding movement in the bore 80, this operating member having a portion 94 of a diameter corresponding to the bore portion 82, having a smaller diameter portion 96 separated from the operating member portion 94 by a shoulder 95 adapted to slide past the bore shoulder 86, having a cylindrical recess 98 at one end of the operating member, and having two openings 100 and 102 opening into the recess 98 from the periphery of the operating member. If desired, the operating member is formed of three parts, 101, 103 and 105 joined by a screw 106. Preferably the operating member has a shoulder 116 limiting sliding of the member into the bushing 72.

The circuit breaker 10 also has a coil compression spring 124 normally biasing the operating member 92 upwardly toward the open circuit position shown in FIG. 3. A first latching member 126 is then disposed in the recess 98, this member 126 being of a generally cylindrical configuration having large diameter portions 130 and 132, a small diameter portion 128, and tapered cam portions 134 and 136 between the large and small diameter portions. The first latching member also has a shank portion 138 joined to the large diameter portion 132 at the shoulder 140 and having a stop or retaining ring 142 secured at the end of the shank 138.

A latching plate 144 is provided with a central opening 146 fitted around the shank part of the first latching member 126 and has a counterbore 150 receiving the stop 142. A compression spring 152 fitted around the shank 138 bears against the shoulder 140 and normally biases the latching plate 144 toward the stop 142. As shown in enlarged scale in FIG. 2, the latching plate 144 is preferably molded of a rigid electrically insulating material such as a phenolic resin and has a metal plate part 154 embedded therein, to provide the latching plate 144 with a pair of spaced latch surfaces 155 and 157 at opposite sides of the latching plate. As shown in FIG. 1, these latch surfaces 155 and 157 are normally disposed in engagement with the distal ends of the respective arms 52 and 54 of the movable contact member 32. The latching plate 144 is of generally rectangular configuration and is proportioned and positioned between the casing halves 14 so that there is no tendency for the plate to rotate around the shank 138, thereby retaining latch surfaces 155 and 157 generally aligned with the distal ends of the arm 52 and 54 as shown in FIG. 1. A pair of latching balls 158 and 160 are disposed in the respective apertures 100 and 102 in the first latching member 126.

In operation of the circuit breaker 10 as thus far described, it can be seen that, with the circuit breaker in its closed circuit position as shown in FIG. 1, the bridging contact member engages contacts 48 and 50 with contacts 28 and 30 closing an electrical circuit between the terminals 24 and 26. Although the bridging contact member is biased toward the open circuit position shown in FIG. 3 by the spring 62, the engagement of the contact members arms 52 and 54 with the latch surfaces 155 and 157 retains the briding contact member in its closed circuit position. That is, when the latching balls 158 and 160 are disposed as shown in FIG. 1 in engagement with the shoulder 90 on the bushing 72, the operating member 92 is held in the position shown in FIG. 1 against the bias of the spring 124. Similarly, the cam surface 136 of first latching member 126 is held against the balls 158 and 160 by the spring 152 which is compressed between the shoulder 140 and the latching plate 144.

If manual opening of the circuit between the terminals 24 and 26 is desired, the operating member 92 is merely pulled. This pulling cams the balls 158 and 160 inwardly from the shoulder 90 further compressing the spring 152 until, when the balls clear the shoulder 90, the entire latch mechanism 70 moves to the open circuit position shown in FIG. 3 under bias of the spring 124, thereby permitting the bridging contact member 32 to move to its open circuit position under bias of the spring 62.

If manual closing of the circuit breaker is then desired, the operating member 92 is merely depressed. This depressing movement lowers the latching mechanism 70 until the latch surfaces 155 and 157 again engage the distal ends of the contact member arms 52 and 54 and again return the contact member 32 to its closed circuit position. At this point in the downward movement of the latching mechanism 70, the balls 158 and 160 are again cammed into latching engagement with the shoulder 90 by the cam surface 136 under bias of the spring 152, again latching the circuit breaker in its closed circuit position and lifting the latch plate 144 a short distance off the stop 142.

The circuit breaker 10 is also adapted to move automatically to open circuit position in response to the occurrence of an overload current in the electrical circuit between the terminals 24 and 26. That is, when such an overload current occurs in the circuit, the current flowing between the terminals passes through the bimetallic portion 34 of the contact member causing the center of the contact member to flex upwardly and causing the distal ends of the contact member arm 52 and 54 to move away from each other and to tend to slide from the latch surfaces 155 and 157 on the latch plate 144. As will be understood, when the arms 52 and 54 slide from the latch surfaces, the contact member 32 moves toward open circuit position under bias of the spring 62. Further, the latch plate 144 is permitted to move downwardly between the arms 52 and 54 toward the stop 142 under bias of the spring 152. Note that the stop 142 permits small downward movement of the latch plate 144 on the shank 138. As a result, the balls 158 and 160 are no longer cammed against the shoulder 70, thereby permitting the balls to clear the shoulder so that the latching mechanisms 70 moves to its open circuit position as shown in FIG. 3 under the bias of spring 124. Note that in this arrangement, the circuit breaker 10 is trip free in that, the breaker circuit cannot be reclosed until the thermostatic portion of the contact member 32 has cooled sufficiently so that the arms 52 and 54 move back together to the point where they can be reengaged by the latch surfaces 155 and 157. As thus far described, the circuit breaker 10 corresponds to the circuit breaker described in U.S. Pat. No. 3,564,174.

Figure 2:
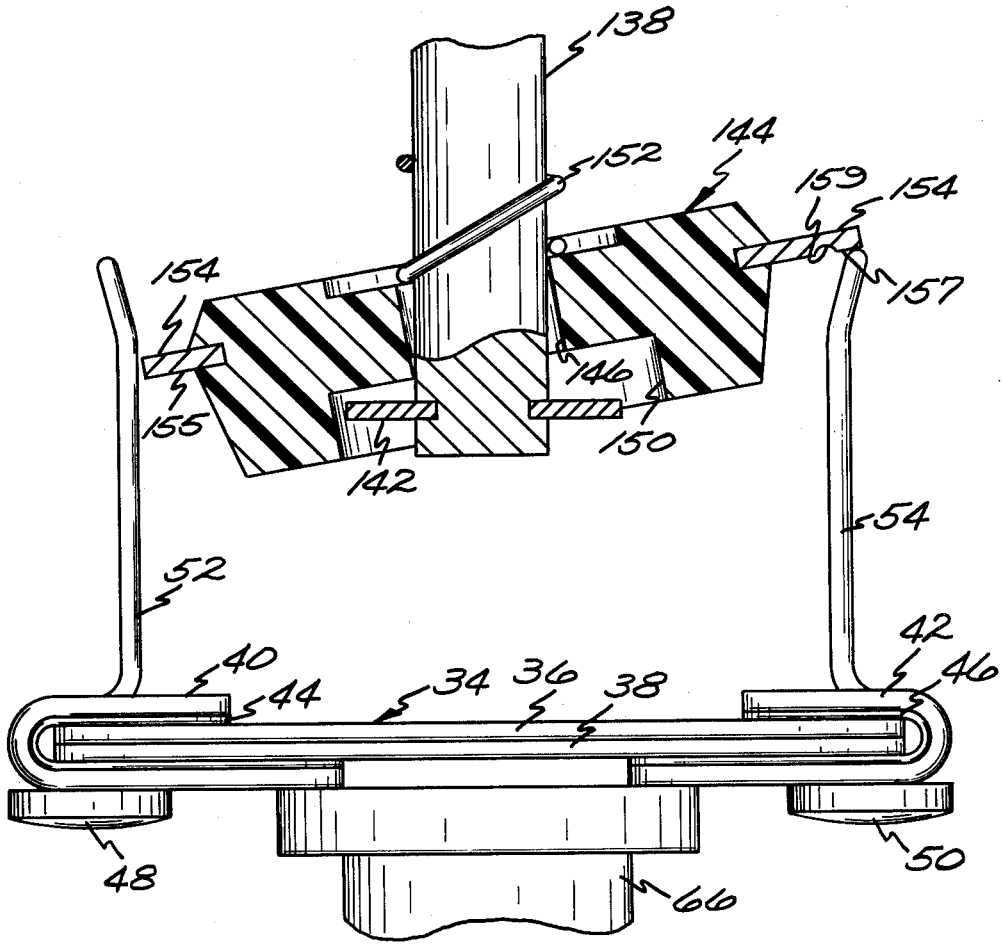
FIG. 2 is a partial view to enlarged scale similar to FIG. 1 illustrating the circuit breaker in another device position.

In accordance with this invention, however, one of the latch surfaces 157 is provided with surface means which retard sliding movement of the distal end of arm 54 on that latch surface as compared with the easier sliding movement of the distal end of arm 52 on the latch surface 155. Preferably, for example, as is best shown in FIGS. 2 and 3, the surface means retarding sliding movement on the surface 157 comprises a shallow groove 159 formed on the latch surface. Typically, for example, where the plate part 156 is of beryllium copper, the groove 159 has a depth in the range from about 0.0015 to 0.0030 inches, has a width of about 0.010 inches, and has a length adequate to accommodate the distal end of arm 54 which preferably sets into the groove as shown in FIG. 1.

In this arrangement, when the thermostatic portion 34 of the contact member 32 is heated by an overload current in the circuit between the terminals 24 and 26, substantially all flexing movement of the contact member is preferentially reflected in sliding movement of the arm 52 on the latch surface 155. Then, as the distal end of arm 52 slides from the surface 155, the latch plate 144 is normally free to tilt on the shank 138 as shown in FIG. 2 for releasing the other arm 54 from the latch surface 157, thereby permitting the circuit breaker to move automatically to open circuit position in the manner above-described. Further, because the surface means 159 provided on the latch surface 157 are only proportioned to retard sliding movement of the arm 54 on that surface, the arm 54 is adapted to slide off the surface means 159 and from the surface 157 on the occurrence of an overload current even if an attempt is made to retain the latching mechanisms 70 in closed position by manual pressure on the operating member 92. However, the presence of the surface means 159 on the latch surface 157 does assure that both arms 52 and 54 do not tend to slide at random and intermittent intervals across both of the latch surfaces as the thermostatic portion of the contact member is progressively heated by an overload current. In this way, the surface means 159 serve to allow automatic circuit breaker opening at a more precisely predetermined overcurrent level and permit the circuit breaker to be operated with very close tolerances with respect to the overcurrent setting thereof.

It should be understood that although a preferred embodiment of the circuit breaker of this invention has been described by way of illustrating the invention, various modifications and equivalents of the illustrated embodiment are also with the scope of this invention. Thus, various releasable latching mechanisms such as those shown in U.S. Pat. No. 2,912,546, U.S. Pat. No. 3,210,501, U.S. Pat. No. 3,042,776 and U.S. Pat. No. 3,356,816 could be employed in the circuit breaker 10 with the scope of this invention. Further, the bimetal portion 34 of the contact member 32 as above-described could be replaced with thermostatic means such as shown in the latter two of the above-noted patents. Similarly, other surface means than the shallow groove 159 can be provided on the latch surface 157, or on the end of the arm 54, to relatively retard sliding movement of the arm on the latch surface. Such other modifications and equivalents of the disclosed embodiments as fall within the scope of the appended claims are also included in this invention.

I claim:

1. A circuit breaker comprising a base, first electrical contact means mounted on the base, thermostatic contact means movable between a closed circuit position engaging the first contact means and an open circuit position spaced from the first contact means, the thermostatic contact means having a pair of arms extending therefrom in spaced side-by-side relation to each other and having a thermostatic portion for moving the distal ends of the arms relative to each other in response to an increase in temperature, means biasing the thermostatic contact means to open circuit position, and manually movable latch means having a pair of spaced latch surfaces slidably engageable with the distal ends of the respective arms for manually moving the thermostatic contact means into closed circuit position against said bias and for permitting the distal arm ends to slide from said surfaces when the thermostatic portion of the thermostatic contact means is heated to a selected temperature, thereby to allow the thermostatic contact means to move automatically to open circuit position under said bias, one of the latch surfaces having surface means thereon relatively retarding sliding movement of a distal arm end thereon for permitting preferential sliding of the other distal arm end from the other latch surface.

2. A circuit breaker comprising a base, a pair of first electrical contacts mounted in spaced relation to each other on the base, a thermostatic contact member movable between a closed circuit position bridging the first contacts and an open circuit position spaced from the first contacts, the thermostatic contact members having a pair of arms extending therefrom in spaced side-by-side relation and having a thermostatic portion for moving the distal ends of the contact member arms apart in response to an increase in temperature of the thermostatic portion, means biasing the thermostatic contact member to open circuit position, and manually movable latch means having a pair of spaced latch surfaces slidably engageable with the distal ends of the respective contact member arms for manually moving the contact member to closed circuit position against said bias and for permitting the distal arm ends to slide from said surfaces when the thermostatic portion of the contact member is heated to a selected temperature in response to the occurrence of a predetermined overload current in the breaker circuit, thereby to allow the contact member to move automatically to open circuit position in response to said bias, one of the latch surfaces having surface means thereon relatively retarding sliding movement of one distal arm end on that surface for permitting preferential sliding of the other distal arm end from the other latch surface when the thermostatic portion of the contact member is heated by said overload current.

3. A circuit breaker as set forth in claim 2 wherein said surface means on said one latch surface comprises a groove in said one latch surface adapted to receive and retard sliding movement of said one distal arm end on that surface.

4. A circuit breaker comprising a base, a pair of first electrical contacts mounted in spaced relation to each other on the base, a thermostatic contact member movable between a closed circuit position bridging the first contacts and an open circuit position spaced from the first contacts, the contact member having a pair of arms extending therefrom in spaced side-by-side relation to each other and having a thermostatic portion for moving the distal ends of the arms apart in response to increase in temperature of the thermostatic portion, first spring means biasing the contact member toward open circuit position, a latch plate having a pair of spaced latch surfaces adapted to engage the distal ends of the respective contact member arms for moving the contact member against the spring bias and for permitting the distal arm ends to slide from the latch surfaces when the thermostatic portion of the contact member is heated to a selected temperature in response to the occurrence of a predetermined overload current in the breaker circuit, thereby to allow the contact member to move automatically to open circuit position under the spring bias, one of the latch surfaces having a surface groove thereon relatively retarding sliding movement of a distal arm end on that surface for permitting preferential sliding movement of the other distal arm end from the other latch surface when the thermostatic portion of the contact member is heated, and a latch mechanism tiltably mounting the latch plate for manually moving the contact member to closed circuit position, the latch mechanism having means detachably latching the latch plate to retain the contact member in closed circuit position while the latch surfaces are engaged with the distal ends of the contact member arms.

* * * * *